US005476205A

United States Patent [19]

Canlas et al.

[11] Patent Number: 5,476,205

[45] Date of Patent: Dec. 19, 1995

[54] MAKE AND BREAK HEAD VALVE ASSEMBLY

[75] Inventors: Prudencio S. Canlas, North Kingstown; Donald R. Perron, North Providence, both of R.I.

[73] Assignee: Stanley-Bostitch, Inc., East Greenwich, R.I.

[21] Appl. No.: 361,482

[22] Filed: Dec. 22, 1994

[51] Int. Cl.[6] ..... B25C 5/13; F15B 11/08

[52] U.S. Cl. ..... 227/130; 91/461

[58] Field of Search ..... 227/120, 130, 227/8, 156; 91/426, 442, 461, 468

[56] References Cited

U.S. PATENT DOCUMENTS

| | | | |
|---|---|---|---|
| 3,437,013 | 4/1969 | Volkmann | 91/461 |
| 4,667,572 | 5/1987 | Ellieson | 227/130 |
| 4,784,308 | 11/1988 | Novak et al. | 227/130 |
| 5,085,126 | 2/1992 | Mukoyama . | |
| 5,131,579 | 7/1992 | Okkushima et al. | 227/130 |
| 5,259,465 | 11/1993 | Mukoyama | 227/130 |

*Primary Examiner*—Scott A. Smith
*Attorney, Agent, or Firm*—Cushman Darby & Cushman

[57] ABSTRACT

A pneumatically operated fastener driving device is provided including an inlet head valve structure mounted within a housing for movement between (1) a closed position sealing a piston chamber from communication with a main air pressure reservoir and (2) an open position enabling the main air pressure reservoir to communicate with the piston chamber, and an outlet head valve structure mounted within the housing for movement separate from the inlet head valve structure between (1) a closed position sealing the piston chamber from communication with an exhaust opening and (2) an open position enabling the piston chamber to communicate with the exhaust opening. The inlet and outlet head valve structures include first and second reservoir pressure responsive surfaces respectively. The inlet and outlet head valve structures include first and second pilot pressure responsive surfaces disposed in opposing relation to the reservoir pressure responsive surfaces respectively and in continuous communicating relation to the pressure within a pilot pressure chamber so as to bias the inlet head valve structure to move in an opposite direction toward its closed position and the outlet head valve structure to move in the same opposite direction toward its open position. A spring is provided to bias the inlet head valve structure so it (1) moves to its open position after movement of the outlet valve to its closed position in one direction and (2) moves to its closed position prior to movement of the outlet valve structure to its open position in an opposite direction.

8 Claims, 6 Drawing Sheets

MAKE AND BREAK HEAD VALVE ASSEMBLY

BACKGROUND OF THE INVENTION

The invention relates to a fastener driving device and, more particularly, to a pneumatically actuated fastener driving device having a sequentially operated head valve that controls the loss of compressed air during the drive stroke and during the exhaust cycle.

A typical pressure operating fastener driving device includes a portable housing defining a guide track, a magazine assembly for feeding successive fasteners laterally into the guide track, a fastener driving element slidable in the drive track, a piston and cylinder arrangement for moving the fastener driving element through a cycle which includes a drive stroke and a return stroke, a main valve assembly for controlling communication of the cylinder with air under pressure communicated with the device and with the atmosphere to affect the cycling, and a manually operable valve for controlling the main valve assembly through pilot pressure.

A commonly used main valve assembly includes a one-piece valve member movable between two limiting positions. In one position of the valve member, the cylinder inlet is closed and the exhaust port is opened while in the other position, the cylinder inlet is open while the exhaust port is closed. In operation, the drive stroke is initiated by moving the valve member from its inlet closing position toward its inlet opening position. In the one-piece valve member arrangement, optimum communication of the driving pressure with the piston is obtained since such communication begins with the beginning of the movement of the valve member. However, closing of the exhaust port does not occur until movement of the valve member is completed, which may take a finite amount of time. During the return stroke, the exhaust port is opened initially and the inlet is not closed until valve member movement is completed, which again requires a finite amount of time. Consequently, it is well known that, due to the less rapid inlet closing movement of the valve member, some pressure is lost through the opening of the exhaust port before the inlet is closed. Air loss can be appreciable when the tool is used at high speed resulting in lower energy in succeeding cycles.

It is known that the air losses discussed above can be eliminated by using a main valve having separate inlet and exhaust valve members which are moved in sequence. Conventional arrangements of this type of main valve will close the exhaust before opening the inlet member during the drive stroke, thus eliminating the condition which caused the air losses discussed above. One such conventional driving device having a main valve which is sequentially operated was disclosed in U.S. Pat. No. 5,085,126 to Mukoyama. The main valve includes a first valve member which is movable from a first position which prevents communication of a main air reservoir with a piston chamber to a second position which permits communication between the main air reservoir and the piston chamber. The main valve further includes a second valve member which is movable from a first position communicating the piston chamber with an exhaust port to a second position which prevents the piston chamber from communicating with the exhaust port. The sequential movement of this main valve is mechanically accomplished. Thus, the first valve member moves in response to a pressure change established in a pilot pressure chamber. The first valve member thereafter engages the second valve member so as to move the second valve member to its second position to permit reservoir pressure to enter a piston chamber to drive the piston. Although the device of Mukoyama ensures positive sequential movement of the main valve, continuous operation of the device may cause wear due to the contact of the first valve member with the second valve member which may ultimately result in damage to the main valve.

SUMMARY OF THE INVENTION

An object of the present invention is the provision of a pneumatic fastener driving device of the type described having an improved sequentially operated main or head valve that prevents the loss of compressed air during either the driving (intake) stroke, or during the discharge (exhaust) cycle. The head valve according to the principles of the present invention enables the device to close or open an air passage to atmosphere before the driving stroke or discharge cycle, respectively, for greater efficiency. The head valve operates sequentially without requiring contact between inlet and outlet valves thereof.

In accordance with the principles of the present invention, this objective is obtained by providing a pneumatically operated fastener driving device including a housing defining a fastener drive track, a fastener magazine assembly for feeding successive fasteners laterally into the drive track, a fastener driving element slidably mounted in the drive track for movement through an operative cycle including a drive stroke during which a fastener within the drive track is engaged and moved longitudinally outward of the drive track into a work piece and a return stroke, a drive piston connected with the fastener driving element, a cylinder within which the piston is reciprocally mounted, a main air pressure reservoir communicating exteriorly with one end of the cylinder, a piston chamber defined at the one end of the cylinder and communicating with the drive piston, an exhaust opening defined in the housing. The device includes an inlet head valve structure mounted within the housing for movement between (1) a closed position sealing the piston chamber from communication with the main air pressure reservoir and (2) an open position enabling the main air pressure reservoir to communicate with the piston chamber, and an outlet head valve structure mounted within the housing for movement separate from the inlet head valve structure between (1) a closed position sealing the piston chamber from communication with the exhaust opening and (2) an open position enabling the piston chamber to communicate with the exhaust opening. Means are provided defining a pilot pressure chamber. The inlet and outlet head valve structures include first and second reservoir pressure responsive surfaces respectively disposed in continuous communicating relation to the pressure within the main air pressure reservoir so as to bias the inlet head valve structure to move in one direction toward its open position and the outlet head valve structure to move in the same direction toward its closed position. The inlet and outlet head valve structures include first and second pilot pressure responsive surfaces disposed in opposing relation to the reservoir pressure responsive surfaces respectively and in continuous communicating relation to the pressure within the pilot pressure chamber so as to bias the inlet head valve structure to move in an opposite direction toward its closed position and the outlet head valve structure to move in the same opposite direction toward its open position communicating the area above the piston with atmospheric pressure. The device includes a pilot pressure valve normally disposed in an inoperative position communicating the pressure within the main air pressure reservoir with the pilot pressure chamber as pilot pressure therein and movable in response to a manual actuating procedure into an operative position discontinuing the communication of the pressure in the main air pressure reservoir with the pilot pressure chamber and exhausting the pilot pressure chamber to atmosphere.

Relative areas of the pressure responsive surfaces are such that the inlet and outlet head valve structures are biased into the closed and open positions thereof respectively by the pilot pressure within the pilot pressure chamber when the pilot pressure valve is in its normal inoperative position so that (1) when the pilot pressure in the pilot pressure chamber is exhausted to atmosphere in response to the movement of the pilot pressure valve into the operative position thereof the inlet and outlet head valve structures are moved from the closed and open positions thereof respectively to the open and closed positions thereof respectively and from the closed position thereof into the open position thereof and (2) when the pilot pressure valve is returned to its inoperative position to communicate pilot pressure with the pilot pressure chamber the inlet and outlet head valve structures are returned to the closed and open positions thereof respectively.

Spring means are provided for biasing the inlet head valve structure toward the closed position thereof so as to cause (1) movement of the inlet head valve structure from the closed position thereof into the open position thereof to follow the movement of the outlet head valve structure from the open position thereof into the closed position thereof to thereby insure reservoir pressure in the main air pressure reservoir cannot be instantaneously exhausted to atmosphere through the exhaust opening, and (2) return movement of the inlet head valve structure into the closed position thereof precedes the return movement of the outlet head valve structure into its open position to thereby insure that reservoir pressure communicating with the piston chamber cannot be instantaneously exhausted to atmosphere through the exhaust opening.

These and other objects of the present invention will become more apparent during the course of the following detailed description and appended claims. The invention may best be understood with reference to the accompanying drawings wherein an illustrative embodiment is shown.

DETAILED DESCRIPTION OF THE PREFERRED EMBODIMENT

Figure 1:
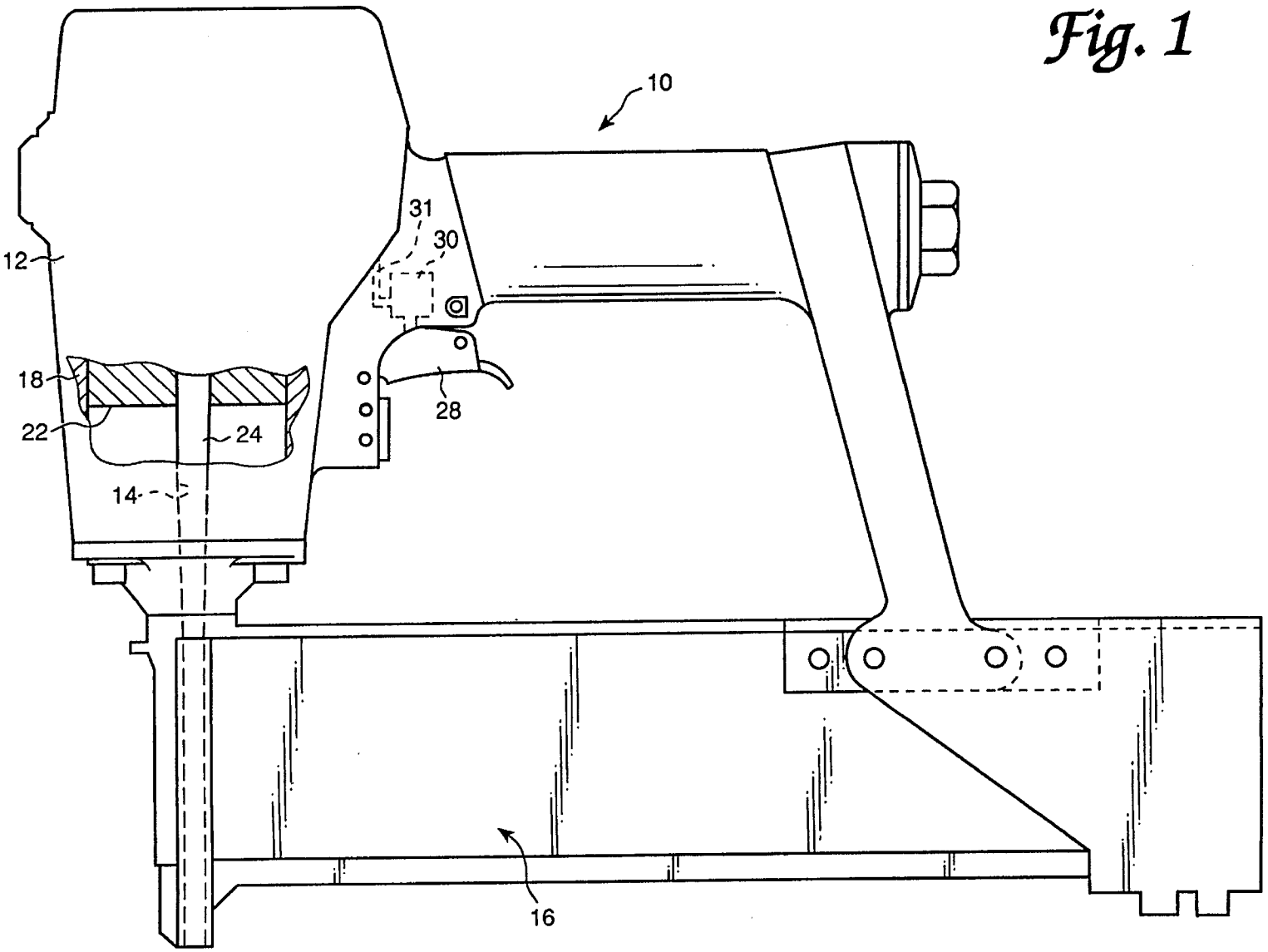
FIG. 1 is a side elevational view of a pneumatically operated fastener driving device embodying the principles of the present invention.

Referring now more particularly to FIG. 1 of the drawings, there is shown therein a pneumatically operated fastener driving device, generally indicated at 10, which embodies principles of the present invention. The device 10 includes a housing 12 including a handle by which the operator is enabled to manually manipulate the device 10. The housing 12 includes the usual nose piece defining a drive track 14 which is adapted to receive laterally therein the leading fastener from a fastener package mounted within a magazine assembly, generally indicated at 16 of conventional construction and operation. A cylinder 18 is mounted within the housing 12 and has an upper end which communicates exteriorly with an annular main air pressure reservoir 20 (FIG. 2) within the housing 12 which extends into the hollow handle thereof. Mounted within a cylinder 18 is a piston 22 which carries a fastener driving element 24 that is slidably mounted within the drive track 14 and movable by the piston and cylinder unit through a cycle of operation which includes a drive stroke during which the fastener driving element 24 engages a fastener within the drive track 14 and moves the fastener longitudinally outward into a work piece, and a return stroke. In order to effect the cycle of operation, there is provided a head valve means, generally indicated at 26 (FIG. 2), constructed in accordance with the principles of the present invention. The head valve means 26 is pilot pressure operated. The pilot pressure is controlled by a trigger 28 which moves a pilot pressure valve 30 in a manner which is well known in the art.

Figure 2:
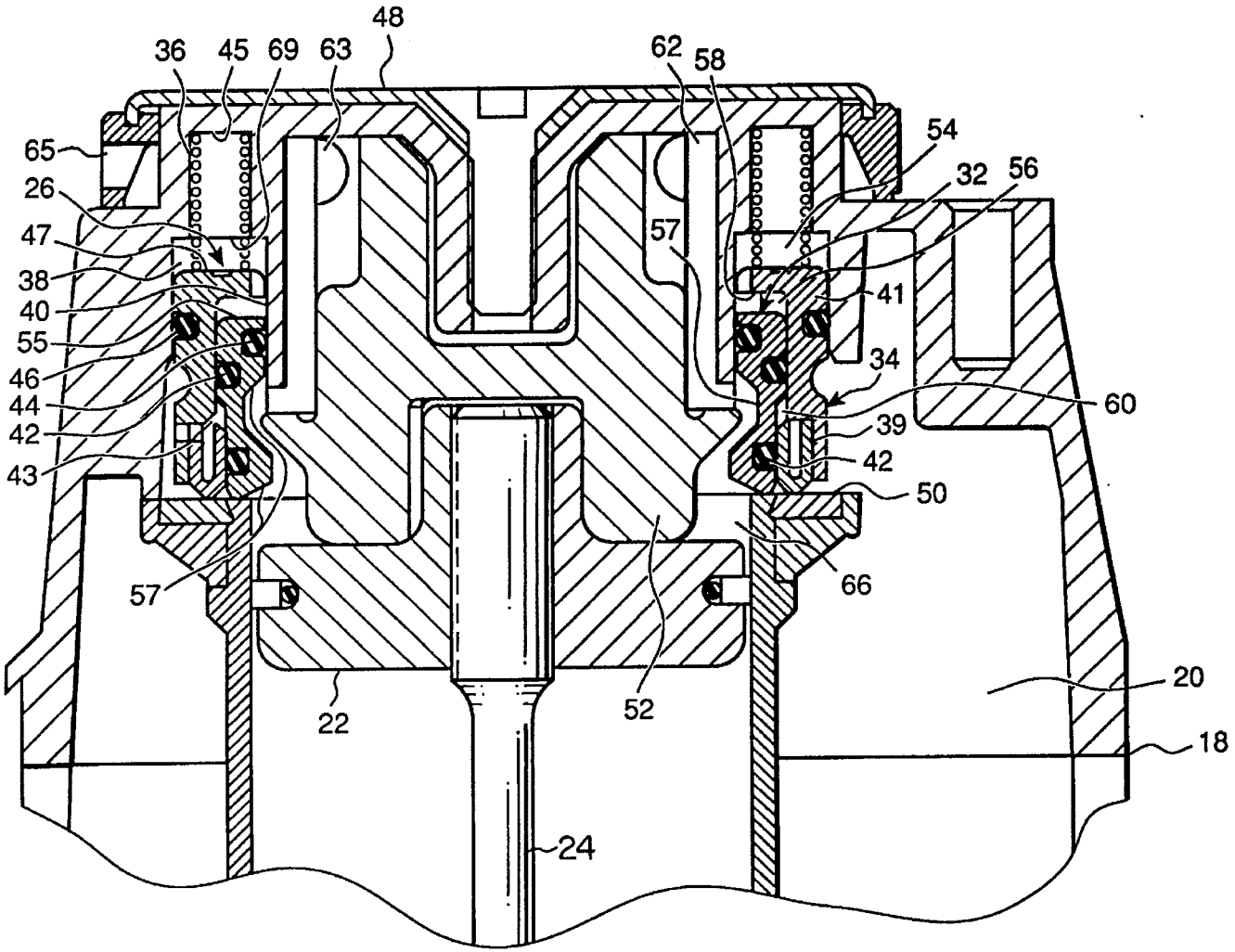
FIG. 2 is an enlarged sectional view showing the head valve means of the present invention with the driving element disposed in an at-rest position.

Referring now more particularly to FIGS. 2–6, the head valve means 26 preferably includes an outlet head valve structure, generally indicated at 32 and an inlet head valve structure, generally indicated at 34. The inlet head valve structure 34 comprises a lower element 39 which is coupled to upper element 41, defining a reservoir pressure passage 43 therebetween, the function of which will become apparent below. As shown in FIG. 2, the upper end of the housing 12 is formed with an annular bore 38. In the illustrated embodiment, biasing means 36 are provided which preferably include spring member/members which are disposed in the bore 38. One end of each spring member is in contact with annular surface 45 of the housing 12 and the other end of each spring member is in contact with surface 47 of the inlet head valve structure 34. The outlet head valve structure 32 is captivated by the inlet head valve structure 34 and bore wall 40. O-rings 42 create a seal between the outlet head valve structure 32 and the inlet head valve structure 34, while O-ring 44 creates a seal between the outlet head valve structure 32 and bore wall 40. O-ring 46 creates a seal between the inlet head valve structure 34 and the housing 12. The outlet and inlet head valve structures are arranged within the bore 38 so as to be adjacent to each other and to be movable independently with respect to each other in the axial direction of the bore 38.

As shown in FIG. 2, the piston 22 is mounted so as to be movable within the cylinder 18. An upper end of the cylinder 18 includes a cylinder seal 50. A piston stop 52 is disposed within the housing so as to limit the upward movement of the piston 22 during the return stroke thereof.

FIG. 2 shows the pneumatic device 10 in an at-rest position with the inlet head valve structure 34 in a closed position in contact with the cylinder seal 50 and the outlet head valve structure 32 disposed in an open position against the upper end of the cylinder 18. In the at-rest position, the piston 22 is held against the piston stop 52. When the head valve means 26 is at rest, a plurality of annular pilot pressure chambers are defined. Main pilot pressure chamber 54 is defined between surface 47 of the inlet head valve structure 34 and surface 69 of the housing 12. Pressure chamber 56 is defined between surface 55 of the outlet head valve structure 32 and the surface 58 of the inlet head valve structure 34. Chamber 60 is defined between the outlet head valve structure 32 and the inlet head valve structure 34 with surface 64 (FIG. 3) defining a wall of chamber 60. Chamber 60 communicates with passage 43 so that reservoir pressure in main pressure reservoir 20 may enter chamber 60. A piston chamber 66 is defined between an upper surface of the piston 22, an upper portion of the cylinder 18 and piston stop 52. The operation of the head valve means 26 in response to pressure differences in the pilot pressure chambers will be appreciated below.

OPERATION

It will be noted that when the housing 12 is connected with a source of air under pressure (as by an air hose or the like leading to the handle of the housing which defines a portion of the main reservoir 20), this pressure (pilot pressure) will communicate through the pilot pressure valve 30, bore 31 and into pilot pressure chambers 54 and 56. It should be noted that the pilot pressure and reservoir pressure are defined to indicate the relative locations of pressure acting within the device. Thus, reservoir pressure communicates with the main air pressure reservoir and pilot pressure communicates with the pilot pressure chamber.

Figure 3:
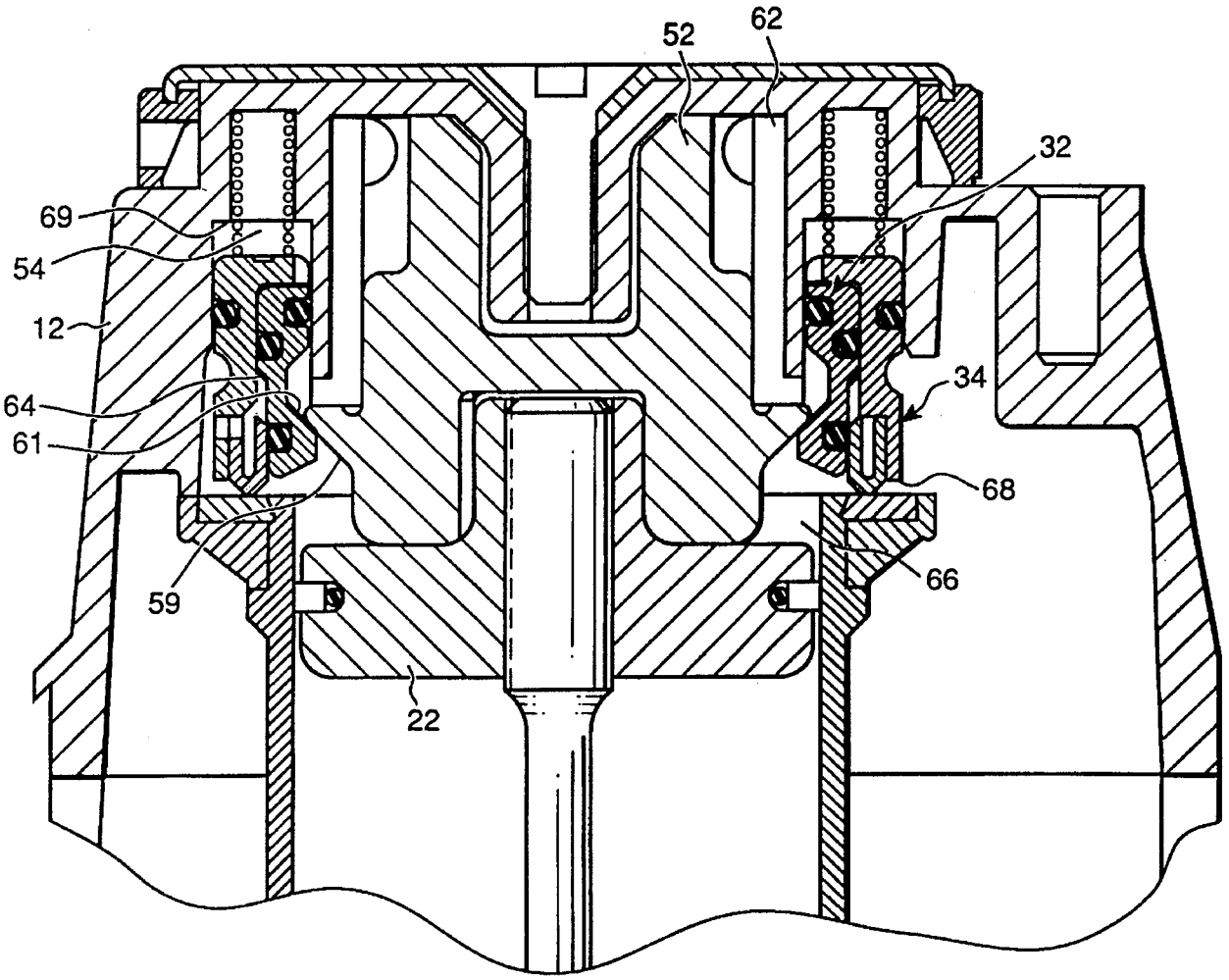
FIG. 3 is a view similar to FIG. 2 showing the initial movement of the outlet head valve structure of the head valve means just after the pilot pressure valve has been triggered.

FIG. 2 shows the head valve means 26 at rest, when the trigger 28 is not actuated. In this first position, reservoir pressure from the compressed air source (not shown) is present in reservoir 20, with pilot pressure communicating with chambers 54, 56, and 60. The inlet head valve structure 34 is biased downward to engage the cylinder seal 50 by biasing means 36 and pilot pressure acting on surface 47 thereof, so that reservoir pressure in main pressure reservoir 20 is prevented from entering the piston chamber 66. In the illustrated embodiment, the outlet head valve structure 32 is biased down purely by differential pressure. This pressure difference is the difference in pressure acting between the top and the bottom of the outlet head valve structure 32. The outlet head valve structure includes a pilot pressure responsive upper surface 55, and opposing atmospheric pressure responsive surfaces 57 and a reservoir pressure responsive surface 64 (FIG. 3). The upper surface 55 of the outlet head valve structure 32 is at chamber 56 which is under pilot pressure and opposing surfaces 57 of the outlet head valve structure 32 are exposed to atmospheric pressure which is present in chamber 62. Chamber 62 communicates with the exhaust opening 63 which is exposed to the atmosphere at exhaust holes 65. Although reservoir pressure is continuously acting on surface 64 of the outlet head valve structure, the area of surface 64 is substantially less than the area of surface 55, thus, the outlet head valve structure 32 is biased downward. It is within the contemplation of the invention that the outlet head valve structure 32 may include springs, employed in conjunction with the above mentioned pressure responsive surfaces, or, as an alternative thereto, to facilitate the appropriate biasing thereof.

The outlet head valve structure 32 includes surfaces defining a notched portion 59 so that when the outlet head valve structure 32 is in its open position, chamber 62 communicates with piston chamber 66, thus exposing piston chamber 66 and chamber 62 to atmospheric pressure.

FIG. 3 shows that the trigger 28 has just been digitally actuated by the operator. When the trigger 28 is actuated, the pilot pressure valve 30 is moved into a position to dump the pilot pressure in chambers 54 and 56 to atmosphere, through only the pilot pressure valve 30, and thus, through the trigger 28. No other exhaust of the pilot pressure chambers 54 and 56 is permitted, thus providing a simple and efficient device. Thus, enough pilot pressure has been discharged from chambers 54 and 56 to permit the outlet head valve structure 32 to move from its open position upward, to its closed position, due to the reservoir pressure in chamber 60 acting on surface 64, which creates a force greater than the force of atmospheric pressure acting on surface 55 of the outlet head valve structure 32. Upward movement of the outlet head valve structure 32 causes a sealing action between annular surface 61 of the outlet head valve structure 32 and annular surface 59 of the piston stop 52. The sealing action blocks-off the top of the piston 22 from the exhaust opening 63. Thus, at this position, no reservoir pressure is present in piston chamber 66, therefore, the piston 22 remains stationary. The inlet head valve structure 34 remains in its closed, biased position engaging the cylinder seal 50 due to the force of the biasing means 36 exerted thereon. At this point, the force generated by the biasing means 36 along with some remaining pilot pressure present in chamber 54 not yet discharged to the atmosphere, is greater than the force acting upon a surface 68 of the inlet head valve structure 34, thus, movement of the inlet head valve structure lags slightly behind the movement of the outlet head valve structure during the upward stroke of the head valve structures.

Figure 4:
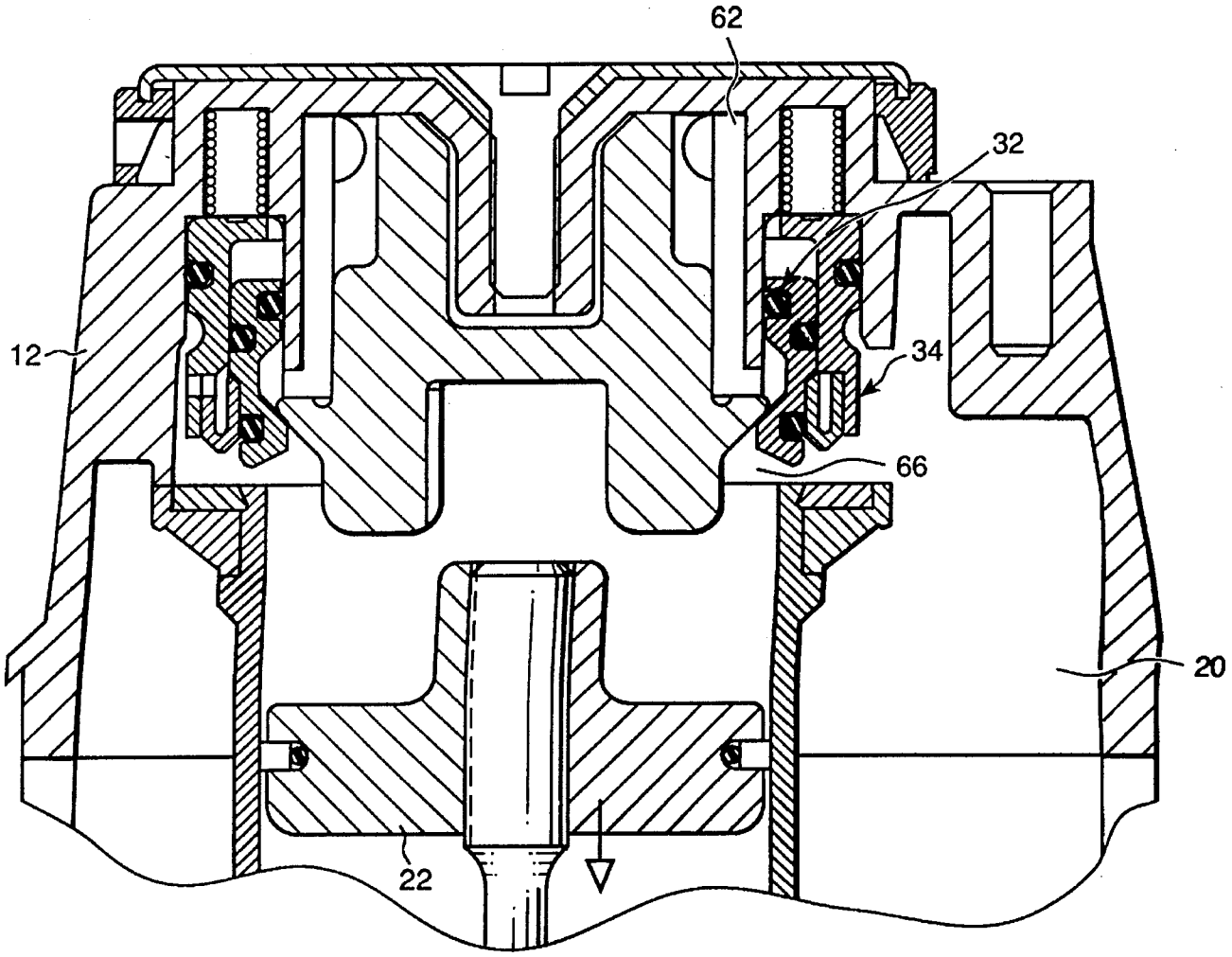
FIG. 4 is a view similar to FIG. 2, showing further movement of the outlet and inlet head valve structures of the head valve means which enables compressed air to contact the driving element, and shows the location of the outlet and inlet head valve structures during the driving stroke of the driving element.

As shown in FIG. 4, the head valve means 26 is in a second stage of operation, during the drive stroke. Thus, FIG. 4 shows a continuation of the movement of the head valve means 26 from its position shown in FIG. 3. At this position of the head valve means 26, the trigger 28 is still actuated. The pilot pressure in main head valve chamber 54 has been removed completely. The inlet head valve structure 34 includes a pilot pressure responsive surface 47 and a reservoir pressure responsive surface 68. Surface 68 of upper portion 41 of the inlet head valve structure 34 communicates continuously with the reservoir pressure in the main air pressure reservoir 20. The force of the reservoir pressure in the main air pressure reservoir 20 acting upward on surface 68 of the inlet head valve structure 34 is greater than the downward force exerted by the biasing means 36 and the atmospheric pressure exerted on surface 47; thus, the inlet head valve structure 34 is biased upward, against surface 69 (FIG. 3) of the housing 12 to its open position (FIG. 4). Since pilot pressure has been removed from chamber 56, an air pressure differential continues to hold the outlet head valve structure 32 upward due to reservoir pressure acting on surface 64, maintaining a sealing action between the outlet head valve structure 32 and the piston stop 52. The sealing action continues to block-off the atmospheric pressure at the exhaust opening 63 from the piston chamber 66. Thus, the top of the piston 22 is now exposed to the reservoir pressure of the main air pressure reservoir 20. As a result, the piston 22 breaks free from the piston stop 52 and rapidly strokes downward within the cylinder 18, defining the drive stroke. Since the outlet head valve structure 32 is sealed against the piston stop 52, the inlet head valve is sealed with the housing 12 by O-ring 46 and a passage between the outlet and inlet head valves is sealed by O-rings 42, the main air pressure reservoir 20 and the piston chamber 66 are prevented from communicating with the main head valve chamber 54 and the atmosphere (chamber 62). Thus, no reservoir pressure is lost to the atmosphere during the drive stroke of the driving element 24.

Figure 5:
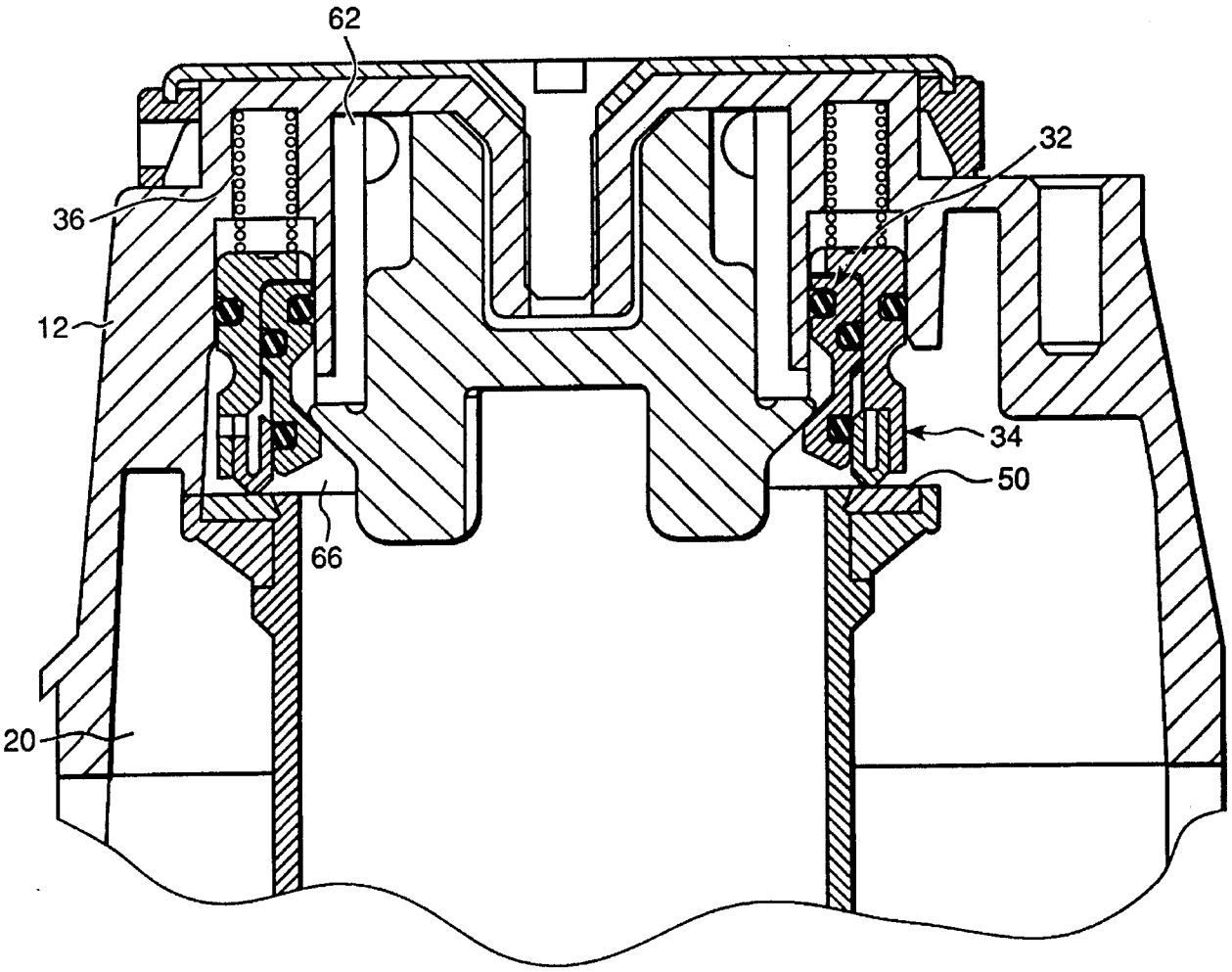
FIG. 5 is a view similar to FIG. 2, showing the initial movement of the inlet head valve just after the pilot pressure valve has been released.

FIG. 5 shows the head valve means 26 at the beginning of its downward cycle. The inlet head valve structure 34 is already biased downward against the cylinder seal 50, while the outlet head valve structure 32 remains in its sealed position against the piston stop 52. The head valve means 26 features a balanced system wherein forces due to air pressure on top thereof are equal to those at the bottom thereof. In order to ensure that the inlet head valve structure 34 will be positively biased to engage the cylinder seal 50 at the end of each stroke prior to movement of the outlet head valve structure, additional downward force is required. The biasing means 36 provide this added downward force.

Figure 6:
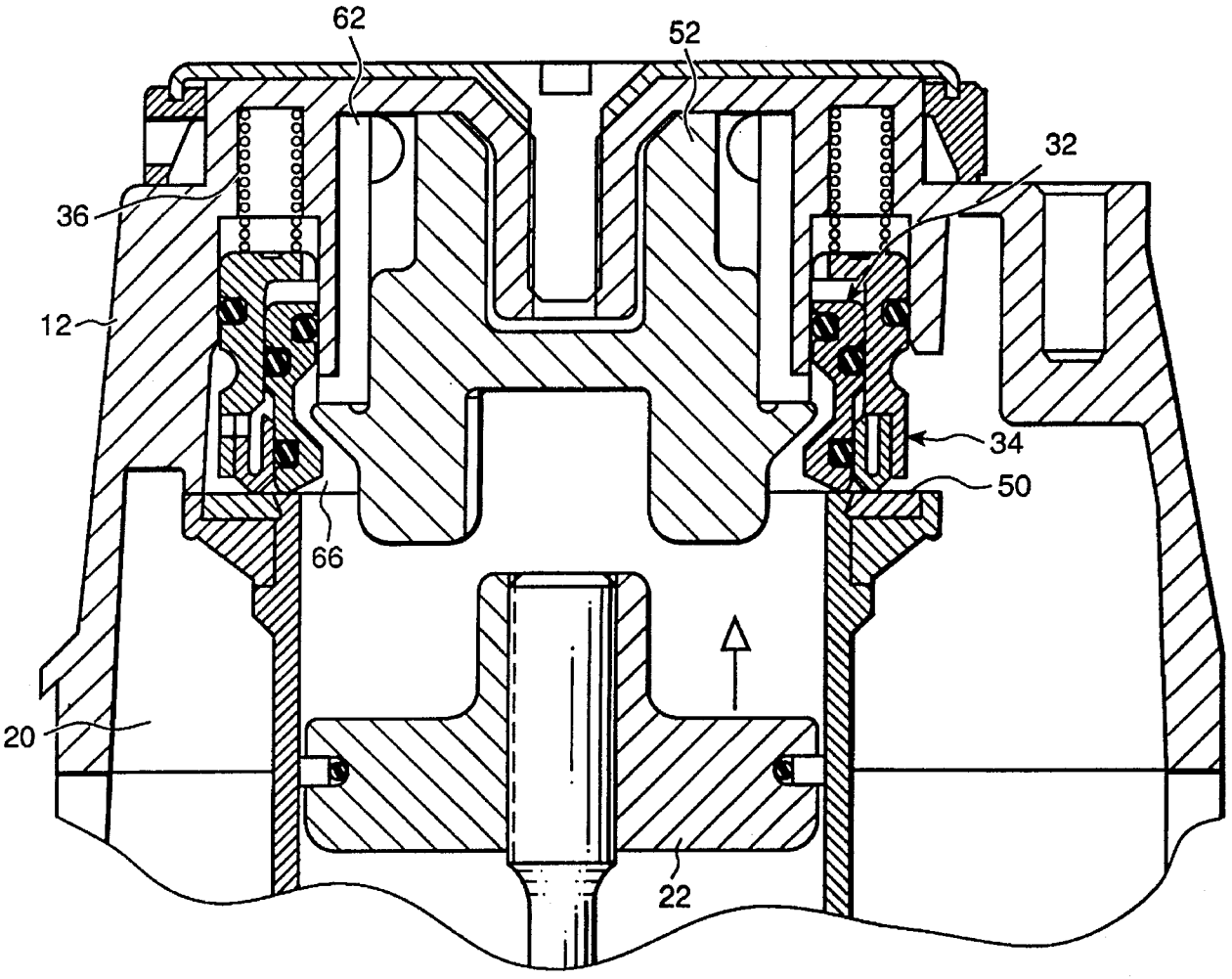
FIG. 6 is a view similar to FIG. 2, showing the position of the outlet and inlet head valve structures during the return stroke of the driving element.

The return stroke is initiated by the disengagement of the trigger 28 or the conventional contact trip (not shown) or both. Thus, disengagement of the trigger 28 or contact trip or both will reverse the pilot pressure valve 30 and thus again communicate chambers 54 and 56 with pilot pressure. As shown in FIG. 6, the inlet head valve structure 34 is in a position biased by the biasing means 36 against the cylinder seal 50 and, to complete the cycle, the outlet head valve structure 32 is biased against the top of the cylinder 18/cylinder seal 50. Such positioning of the outlet head valve structure 32 is made possible due a pressure differential, with the force of the pilot pressure acting on surface 55 being greater than a force of atmospheric pressure acting on an effective opposing lower surface 57 of the outlet head valve structure 32. Since the inlet head valve structure 34 is now in a sealed relationship with the cylinder seal 50, the bottom of the outlet head valve structure 32 is subjected to the atmospheric pressure at exhaust opening 63. The top of the outlet head valve structure 32 is at pilot pressure, thus completing the operating cycle of the device 10, without pressure in the main air pressure chamber, which communicates with the piston chamber, being instantaneously communicated with atmosphere. The head valve means 26 is thus again at the rest position (FIG. 2), ready for the next cycle.

It can thus be seen that the head valve means 26 of the invention is operable to prevent a loss of compressed air during either the driving stroke or the discharge cycle due to the independent and sequential movements of the outlet and inlet head valve structures 32 and 34 as a result of pressure changes which occur in the pilot pressure chamber. The biasing means assures that the proper sequence of movement of the inlet and outlet head valve structures takes place. Thus, the head valve means 26 provides a system to close and open an air passage to atmosphere before the driving cycle or the discharge cycle, respectively, for greater efficiency, without requiring contact of the inlet and outlet head valve structures.

It thus will be seen that the object of this invention has been fully and effectively accomplished. It would be realized, however, that the foregoing preferred specific embodiment has been shown and described for the purposes of illustrating the functional and structural principles of this invention and is subject to change without departure from such principles. Therefore, this invention includes all the modifications encompassed within spirit and scope of the following claims.

What is claimed is:

1. A pneumatically operated fastener driving device comprising:

a housing defining a fastener drive track, a fastener magazine assembly for feeding successive fasteners laterally into the drive track, a fastener driving element slidably mounted in the drive track for movement through an operative cycle including a drive stroke during which a fastener within the drive track is engaged and moved longitudinally outward of the drive track into a work piece and a return stroke, a drive piston connected with the fastener driving element, a cylinder within which the piston is reciprocally mounted, a main air pressure reservoir communicating exteriorly with one end of said cylinder, a piston chamber defined at said one end of said cylinder and communicating with said drive piston, an exhaust opening defined in said housing and communicating with the atmosphere, an inlet head valve structure mounted within said housing for movement between (1) a closed position sealing said piston chamber from communication with said main air pressure reservoir and (2) an open position enabling said main air pressure reservoir to communicate with said piston chamber, an outlet head valve structure mounted within said housing for movement separate from said inlet head valve structure between (1) a closed position sealing said piston chamber from communication with said exhaust opening and (2) an open position enabling said piston chamber to communicate with said exhaust opening, means defining a pilot pressure chamber, said inlet and outlet head valve structures including first and second reservoir pressure responsive surfaces respectively disposed in continuous communicating relation to the pressure within said main air pressure reservoir so as to bias said inlet head valve structure to move in one direction toward its open position and said outlet head valve structure to move in the same direction toward its closed position, said inlet and outlet head valve structures including first and second pilot pressure responsive surfaces disposed in opposing relation to said reservoir pressure responsive surfaces respectively and in continuous communicating relation to the pressure within said pilot pressure chamber so as to bias said inlet head valve structure to move in an opposite direction toward its closed position and said outlet head valve structure to move in the same opposite direction toward its open position, a pilot pressure valve normally disposed in an inoperative position communicating the pressure within said main air pressure reservoir with said pilot pressure chamber as pilot pressure therein and movable in response to a manual actuating procedure into an operative position discontinuing the communication of the pressure in the main air pressure reservoir with said pilot pressure chamber and exhausting said pilot pressure chamber to atmosphere, relative areas of said pressure responsive surfaces being such that said inlet and outlet head valve structures are biased into the closed and open positions thereof respectively by the pilot pressure within said pilot pressure chamber when said pilot pressure valve is in its normal inoperative position so that (1) when the pilot pressure in said pilot pressure chamber is exhausted to atmosphere in response to the movement of said pilot pressure valve into the operative position thereof said inlet and outlet head valve structures are moved from the closed and open positions thereof respectively to the open and closed positions thereof respectively and from the closed position thereof into the open position thereof and (2) when the pilot pressure valve is returned to its inoperative position to communicate pilot pressure with said pilot pressure chamber said inlet and outlet head valve structures are returned to the closed and open positions thereof respectively, spring means for biasing said inlet head valve structure in said opposite direction toward the closed position thereof so as to cause (1) movement of said inlet head valve structure from the closed position thereof into the open position thereof to follow the movement of said outlet head valve structure from the open position thereof into the closed position thereof to thereby insure reservoir pressure in said main air pressure reservoir cannot be instantaneously exhausted to atmosphere through the exhaust opening, and (2) return movement of said inlet head valve structure into the closed position thereof precedes the return movement of said outlet head valve structure into its open position to thereby insure that reservoir pressure communicating with the piston chamber cannot be instantaneously exhausted to atmosphere through said exhaust opening.

2. The pneumatically operated fastener driving device as defined in claim 1, wherein said inlet and outlet head valve structures are adjacently disposed within an annular bore in the housing and slidably movable with respect to each other in the axial direction of the bore, a pressure chamber being defined between said inlet and said outlet head valve structures, said reservoir pressure responsive surface of said outlet head valve structure defining a wall of said pressure chamber.

3. The pneumatically operated fastener driving device as defined in claim 2, wherein said inlet head valve structure comprises first and second members, said first member including said reservoir pressure responsive surface, said second member including a sealing surface so as to seal against said one end of said cylinder when said inlet head valve structure is in its closed position, said first member being coupled to said second member so as to define a reservoir pressure passage therebetween so as to permit reservoir pressure in said main air pressure reservoir to enter said pressure chamber.

4. The pneumatically operated fastener driving device as defined in claim 1, wherein a piston stop element is disposed in said housing so as to engage the piston upon completion of the return stroke, said piston stop element having a peripheral surface, said outlet head valve structure including a sealing surface arranged such that when said outlet head valve structure moves to its closed position, the sealing surface thereof sealingly engages the peripheral surface of the piston stop element so as to prevent communication between the exhaust opening and the piston chamber.

5. The pneumatically operated fastener driving device as defined in claim 4, wherein said peripheral surface of said piston stop element and said sealing surface of said outlet head valve structure are each annular surfaces disposed at an inclination with respect to a longitudinal axis of the driving element.

6. The pneumatically operated fastener driving device as defined in claim 1, wherein said spring means includes at least one spring member, and said cylinder including a cylinder seal structure at said one end, said at least one spring member biasing said inlet head valve structure to its closed position so as to engage said cylinder seal structure thereby preventing communication between the reservoir pressure in the main air pressure reservoir and the piston chamber.

7. The pneumatically operated fastener driving device as defined in claim 6, wherein four spaced spring members bias the inlet head valve structure.

8. The pneumatically operated fastener driving device as defined in claim 1, wherein the outlet head valve structure includes a notched portion disposed so as to enable the piston chamber to communicate with the exhaust opening when the outlet head valve structure is disposed at its open position.

* * * * *